United States Patent [19]

Frelier et al.

[11] Patent Number: 4,949,126

[45] Date of Patent: Aug. 14, 1990

[54] OPTICAL REPRODUCTION APPARATUS AND IMPROVED BELLOWS THEREFOR

[75] Inventors: Calvin A. Frelier, Penfield; David V. Kinney, Hilton, both of N.Y.

[73] Assignee: Eastman Kodak Company, Rochester, N.Y.

[21] Appl. No.: 330,662

[22] Filed: Mar. 30, 1989

[51] Int. Cl.[5] ..... G03G 15/00

[52] U.S. Cl. ..... 355/243; 355/210; 355/232; 354/189; 354/190

[58] Field of Search ..... 355/210, 228, 232, 235, 355/241, 242, 243; 354/187, 190, 191, 192, 193, 194, 189

[56] References Cited

U.S. PATENT DOCUMENTS

| | | | |
|---|---|---|---|
| 577,891 | 3/1897 | Turner | 354/187 |
| 730,468 | 6/1903 | Mills | 354/190 |
| 1,031,786 | 7/1912 | Hajjar | 354/190 X |
| 1,272,029 | 7/1918 | Finn | 354/187 |
| 1,724,566 | 8/1929 | Davidson | 354/190 X |
| 2,619,014 | 11/1952 | Geddes | 354/189 |
| 2,767,630 | 10/1956 | Karpf | 354/189 X |
| 3,587,432 | 6/1971 | Koch | 354/189 X |
| 4,768,058 | 8/1988 | Kowalski | 355/243 |

*Primary Examiner*—A. C. Prescott

*Attorney, Agent, or Firm*—Norman Rushefsky

[57] ABSTRACT

A bellows for use in an exposure station of an electrophotographic copier or other optical reproduction apparatus. In one embodiment the bellows is a dual bellows and has one section thereof coupled to a movable lens for changing the image reduction/magnification ratio of the station. The lens movement is such that movement of the lens from either of the extreme imaging positions to the other is accomplished by collapsing of one of the bellows members and expanding the other bellows member. In an alternative embodiment one of the bellows members is replaced with a rigid cowl-like member.

6 Claims, 5 Drawing Sheets

OPTICAL REPRODUCTION APPARATUS AND IMPROVED BELLOWS THEREFOR

FIELD OF THE INVENTION

This invention relates to optical reproduction apparatus employing bellows and to improved bellows for use in such apparatus.

DESCRIPTION OF THE PRIOR ART

In the prior art, it is known to provide optical reproduction apparatus wherein a subject scene or document to be reproduced is imaged upon a radiation sensitized plate, film or other recording member employing a lens which serves to image the object upon a radiation sensitive member. Such apparatus may comprise camera, copiers, optical printers, etc. In this art, it is known to employ bellows to block exposure of the radiation sensitive member to stray radiation not passing through the lens, but yet to allow movement of the lens relative to the member.

In the U.S. Pat. No. 4,768,058 a bellows is described for use in say copiers wherein, as magnification changes, the bellows everts to enable movement of the lens assembly to positions enabling reproduction of documents either under magnification or reduction.

It has been found that to provide a bellows that everts and yet will have the strength and flexibility required for many years of operation in a copier requires the use of materials that make such bellows relatively expensive.

It is an object of the invention to provide improved reproduction apparatus which provides for movement of a lens relative to an image receiving member which allows an image to be formed on the member with more than one position of the lens and wherein a compact bellows is used to block extraneous radiation from a radiation exposure path.

SUMMARY OF THE INVENTION

The above and other objects of the invention are realized by a reproduction apparatus which comprises:

means for supporting a radiation sensitive member for exposure;

optical means including one or more optical elements for forming an image on said radiation sensitive member;

means for supporting an optical element of said optical means in each of at least two extreme positions, in both of which positions the optical element is positioned in an optical path for forming an image upon the member;

bellows means coupled to said optical element;

said bellows means including an outer pleated bellows movable from collapsed to extended states and an inner light excluding means supported for movement within the outer bellows means;

the pleated bellows being supported at one end by a stationary frame-like member and at a second end by a movable frame-like member, an optical element being movable within the outer bellows during collapsing of this outer bellows and, with the outer bellows collapsed, the optical element being located at one extreme position to one side of said stationary support and, with the outer bellows extended, the optical element being located to the other side of the stationary support.

For a fuller understanding of the nature and objects of our invention, reference should be made to the following detailed description taken in conjunction with the accompanying drawings.

The invention is further realized by a bellows comprising a first pleated bellows member having a forward end and a rearward end and adapted for extension in a first direction and collapsing in a second direction; a second pleated bellows member having a forward end and a rearward end, the rearward end being attached directly to the forward end of said first bellows member, the second pleated bellows member being adapted to move to an extended state with movement of the first pleated bellows member to its collapsed state.

BRIEF DESCRIPTION OF THE DRAWINGS

The subsequent description of the preferred embodiment of the present invention refers to the attached drawings wherein.

DETAILED DESCRIPTION OF THE PREFERRED EMBODIMENTS

Because electrophotographic reproduction apparatus are well known, the present description will be directed in particular to elements forming part of, or cooperating more directly with, the present invention. Apparatus not specifically shown or described herein are selectable from those known in the prior art.

Figure 1:
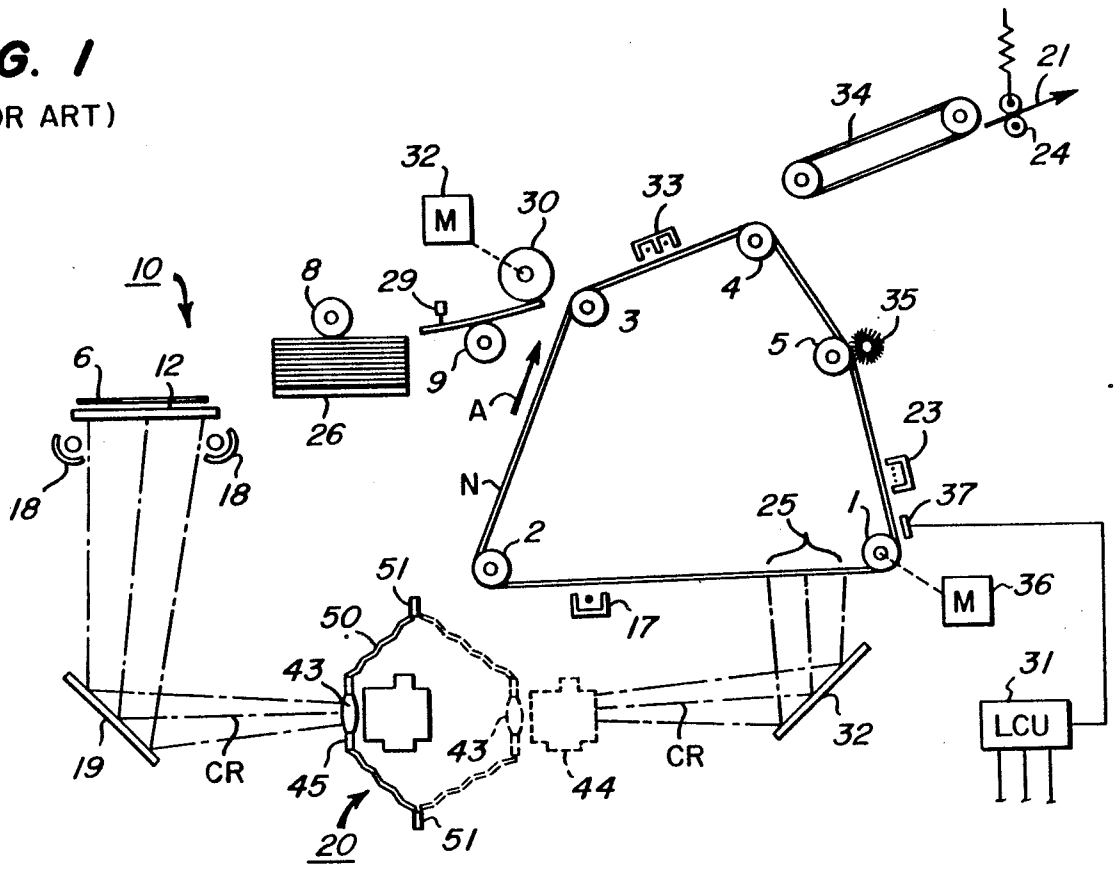
FIG. 1 (PRIOR ART)
FIG. 1 is a schematic elevational view of a portion of an electrophotographic apparatus made in accordance with the prior art.

For a general understanding of an electrostatic type reproduction machine or copier in which the invention may be incorporated, description is made to the above-referenced prior art illustrated in FIG. 1 wherein various components of an exemplary copier machine, designated generally by the numeral 10, are schematically illustrated. As in most electrostatic type machines, a light image of an original or object 6 such as a document sheet to be copied or reproduced is projected onto the sensitized surface of a photoconductive web, herein in the form of a continuously moving endless belt 11 supported on rollers 1–5, to form an electrostatic latent image thereon. A motor 36 is coupled to one of the rollers, say roller 1, for driving the web 11 in the direction of the arrow A. Synchronization of the operation of the various stations forming the apparatus is provided by a logic and control unit (LCU) 31 which in turn receives signals from an encoder 37 that senses indicia associated with the web 11. The latent image is then developed as by means of magnetic brushes at a development area 17 to form a xerographic powder image, corresponding to the latent image on web or belt 11. The powder image is then electrostatically transferred to a support surface such as a copy sheet 21 and then permanently fixed by fusing apparatus 24.

To reproduce an original document sheet 6, the original is illuminated while supported in a plane on glass platen 12. The timing of the flash of xenon flash lamps 18 is controlled by the logic and control unit (LCU) 31 and related to the travel of the web 11 to expose the web to the images of the document sheet. The lamps flood the document sheet with light or other actinic radiation and a reflected image of the doucment sheet is transmitted via mirror 19, lens assembly 20, and mirror 32 in focus to an area 25 lying in the plane of the web 11. One or more corona charging units, exemplified by corona charger 23, is located upstream of the exposure area 25, and applies a uniform primary electrostatic charge, of say negative polarity, to the web 11 as it passes the charger and before it enters the exposure area. The photoconductive properties of the web cause the primary charge in the exposed areas of the web to be discharged in that portion struck by the exposure light. This forms latent imagewise charge patterns on the web in the exposed areas corresponding to the image on the document sheet. Thereafter, travel of the web then brings the area bearing the latent images into the development area 17. The development area, as has been noted, may comprise a magnetic brush development station. Toner particles in station 17 exhibit a triboelectric charge of opposite polarity to the latent imagewise charge pattern. An acutator not shown may selectively move a backup roller into contact with the web 11 to deflect the web from its travel path into operative engagement with a magnetic brush. The charged toner particles of the engaged magnetic brush are attracted to the oppositely charged latent imagewise pattern to develop the pattern.

The developed image frame must be transferred to a receiver sheet to form a reproduction of the original document sheet. Briefly, this is accomplished by feeding a receiver sheet or support 21, from a supply stack stored in hopper 26, in synchronism with movement of the image frame so that the receiver sheet engages the web and is registered by sheet registration mechanism 29 with the image frame such as, for example, by selectively actuating drive rollers 8, 9 and 30. Roller 30 is a vacuum turn-around roller which may provide duplex-type copying on copy sheet 21 in accordance with well known techniques. The image is transferred to the copy sheet by charger 33 that includes a transfer charger and detack charger. The copy sheet is separated from the web and conveyed by vacuum transporter 34 to roller fuser 24 and then to an exit hopper or accessory finishing unit not shown.

While the image is being fixed in fuser 24, the web 11 continues to travel about its path and proceeds through a cleaning area including a cleaning brush 35.

The lens assembly 20 includes a solenoid actuated shutter (not shown) for controlling light to the photoconductive web. The shutter is supported on a conventional carriage (not shown) which also supports lens members 43 and 44. Lens member 43 is a single element lens that is supported within a frame 45 that is in turn movably connected relative to lens member 44 by conventional means not shown but which may comprise slide rails upon which frame 45 slides relative to lens member 44. A cam mounted on lens member 44 and respective cam follower associated with lens 43 may be used to establish the appropriate distances between lens members 43 and 44 for proper focusing of the image on area 25 of web 11. The lens member 44 may be a multi-element lens.

In order to adjust the magnification/reduction ratio of the image upon area 25, the carriage with its accompanying lens members and shutter is moved prior to initiating exposure and in accordance with, for example, inputs provided by the operator to a position providing a desired magnification or reduction of image size. Selection buttons are provided on the copier's operator control panel (not shown) to select the desired magnification or reduction. In response to such selection, an electrical signal is provided to the LCU 31, which in turn provides an electrical signal to a lens driver motor (not shown) which is mechanically coupled to the carriage. The carriage then moves to either the left or the right to the required position for the magnification or reductions selected. In addition, the lens member 43 is moved relative to lens member 44 to maintain the image in focus. It is preferred also to move the carriage on a generally diagonal path relative to the central image light ray (CR) to maintain registration of the image upon the image area 25. In FIG. 1, two positions of lens members 43, 44 are shown. In the position shown in full lines the lens members 43, 44 are in position for forming a magnified or enlarged image of the document sheet 6 upon image area 25. In the position of the lens members 43, 44 shown in phantom, the lens members provide a reduced image of document sheet 6 upon image area 25.

As will be noted in FIG. 1, a bellows assembly 50 is provided between a stationary frame 51 and lens frame 45. The bellows assembly 50 blocks stray light from entering and exposing the photosensitive web 11. In the prior art of FIG. 1, the bellows is used both in its normal and everted states.

Figure 3:
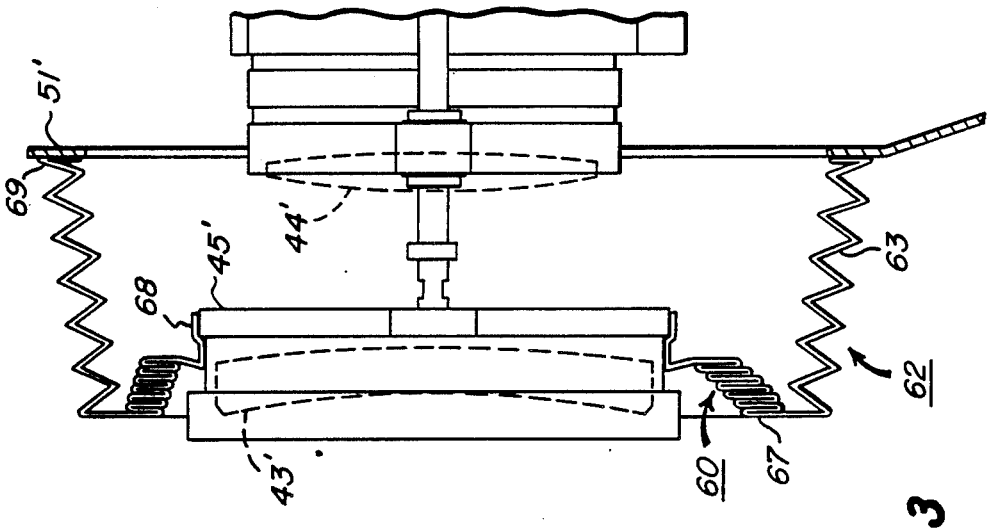
FIG. 3 is a cross-sectional view of the dual bellows of FIG. 2 but showing the bellows in an orientation for making enlargements.
Figure 2:
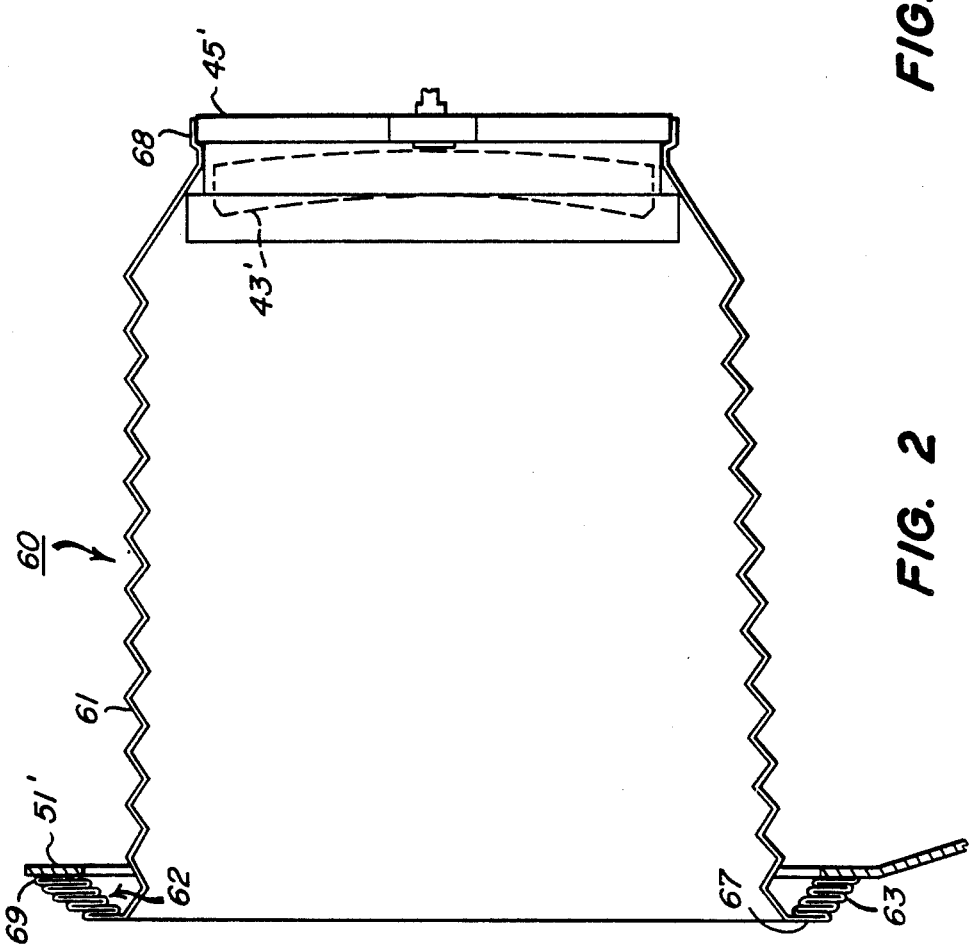
FIG. 2 is a cross-sectional view of an improved dual bellows for use in the apparatus of FIG. 1 and shown with the bellows in an orientation for making copies under a reduction mode.

Reference will now be made to FIGS. 2 and 3. As may be noted in FIG. 2, the dual bellows assembly comprises a first inner bellows member 60 and a second outer bellows member 62. Bellows members 60, 62 each include a plurality of pleated segments 61, 63, respectively, to facilitate collapsing and expansion thereof. Outer bellows member 62 has its rearward end 69 attached to stationary frame 51' by adhesive or clamping. A forward end 68 of inner bellows member 60 is attached to movable frame 45'. Frame 45' has a central opening therethrough within which is mounted a first lens member 43'. A rearward end 67 of inner bellows member 60 is attached to a forward end of outer bellows member 62. As can be seen in FIG. 3, inner bellows section 60 collapses within outer bellows member 52 when the outer bellows member is extended during making copies under an enlargement or magnification mode. In the reduction mode shown in FIG. 2 the outer bellows member 62 is collapsed while the inner bellows member 60 is extended. Inner bellows member 60 is designed so that it totally collapses before the outer bellows member 62 commences to extend. With extension of the outer bellows member 62 due to movement of lens member 43' to the left in FIG. 3 the collapsed inner bellows member 60 moves with this lens member and can be said to be movable within the outer bellows while the lens is moved to an operative position for forming an image. The two pleated bellows members 60, 62 are preferably molded integrally with the rearward end 67 of inner bellows member 60 attached directly to the forward end of outer bellows member 62. Of course, the two bellows members may be formed separately and glued together. In FIG. 3, additional structure is shown illustrating the second lens member 44' being attached to lens member 43' but mounted for relative movement thereto as known in the prior art. In FIGS. 2 and 3, the extreme positions for movement of the members are shown, it being understood that the reproduction apparatus also provides reproductions with magnification/reduction for exposures made between the extreme positions shown.

Figure 4:
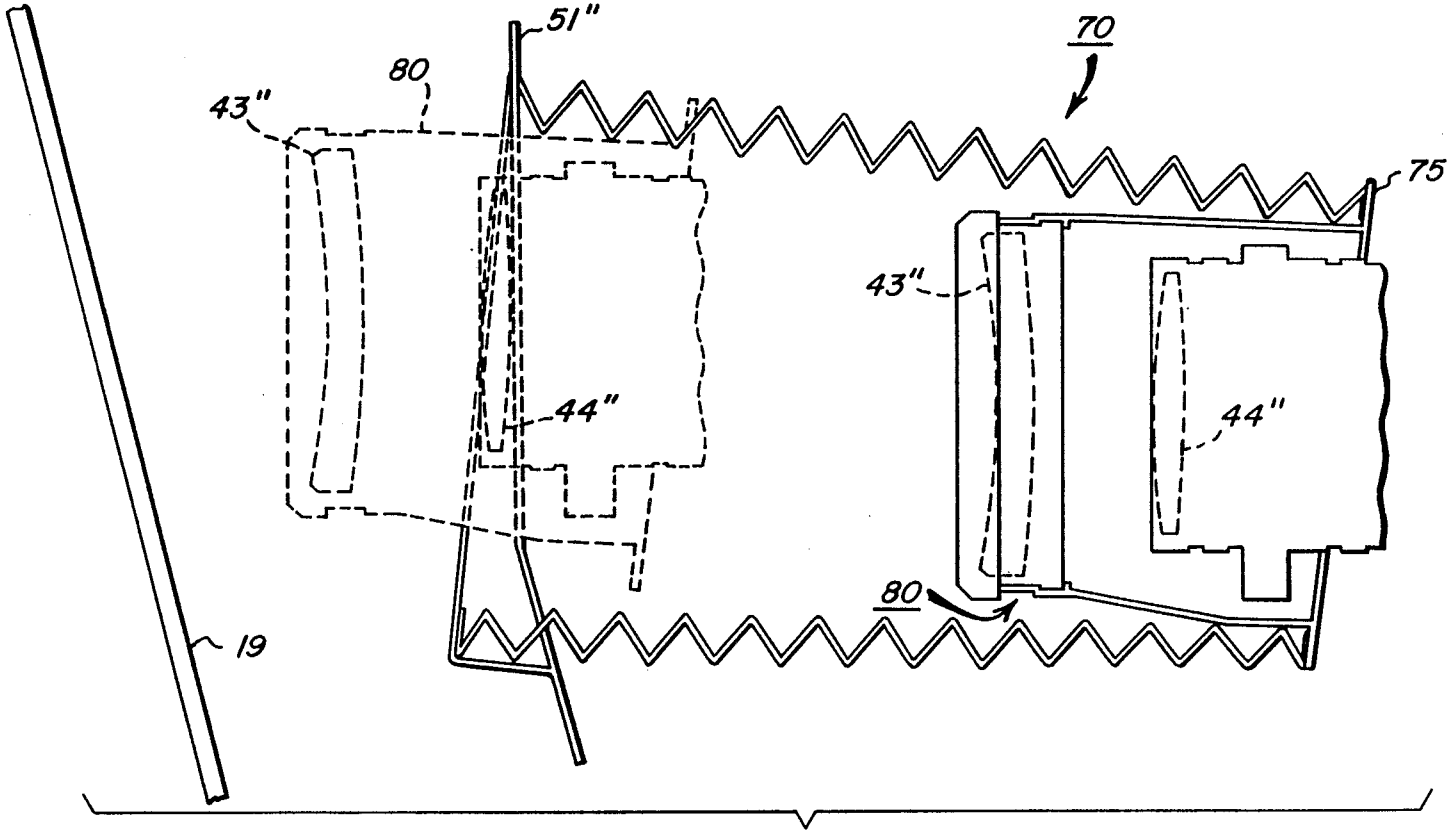
FIG. 4 is a schematic cross-sectional view of an alternative bellows arrangement of the apparatus of the invention and showing the bellows arrangement in an orientation for making copies under a reduction mode.
Figure 5:
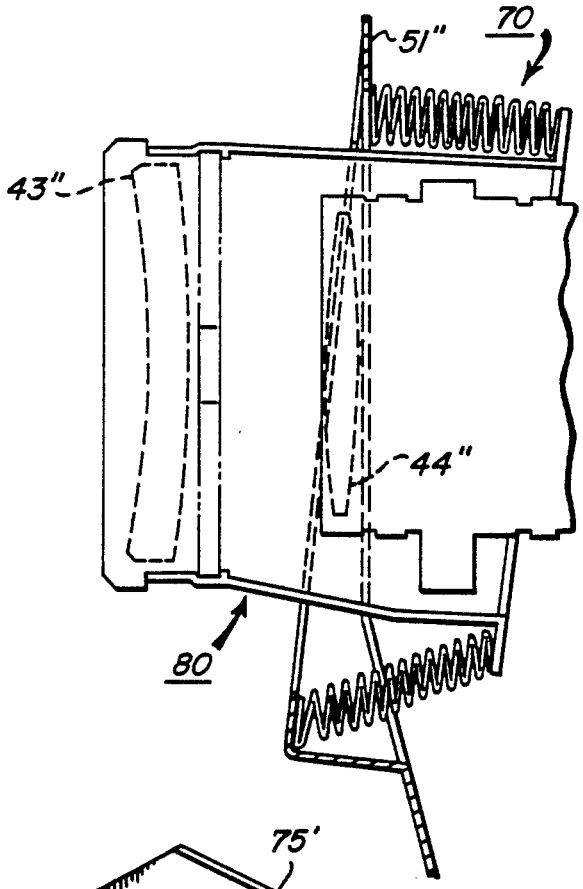
FIG. 5 is a schematic cross-sectional view of the alternative bellows arrangement of FIG. 4, but showing the bellows arrangement is an orientation for making enlargements.

With reference now to FIGS. 4 and 5 an alternative embodiment is described wherein the bellows arrangement comprises an outer collapsible pleated bellows-like member 70 that has one end thereof attached to the stationary frame member designated herein as 51" and a second end thereof attached to a movable frame-like member 75 that is part of a cowl 80. The cowl fits about the lens members 43" and 44" and may be formed in two halves which are coupled together by a conventional band-like fastener or by the means illustrated in FIGS. 7A and 7B to be described. The cowl, once assembled, is thus a rigid structure that moves within outer bellows member 70 as the cowl moves from a reduction copying mode shown in full lines in FIG. 4 to the magnification copying mode shown in phantom in FIG. 4 where the lens 43" is closer to mirror 19.

In FIG. 5, the pleated bellows member 70 is shown in its collapsed state with the lens members 43", 44" moved to a position wherein an enlargement reproduction is to be made. Lens members 43", 44" are also attached by suitable means not shown for movement relative to each other. Lens member 44" as maybe noted is also covered by the cowl 80 to prevent stray light from entering.

Figure 6:
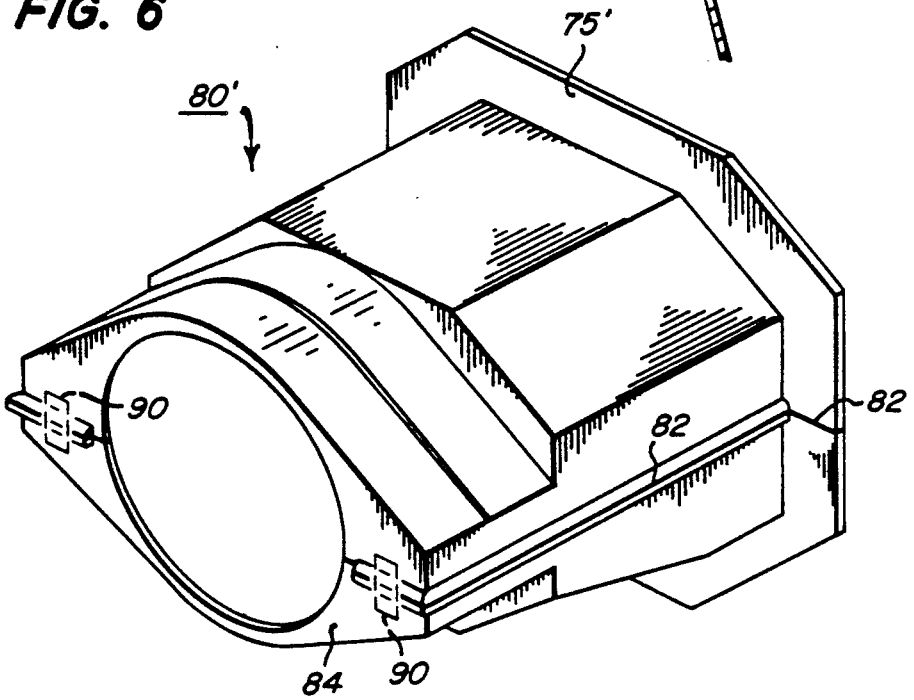
FIG. 6 is a perspective view of a cowl, forming a part of the bellows arrangement of FIG. 5.

Reference will now be made with regard to FIG. 6 wherein a sketch of a preferred cowl structure 80' is illustrated. Cowl 80' is molded of plastic in two halves (upper and lower) that are assembled along line 82. A rear portion of the cowl 80' includes a frame-like flange 75' to which the front portion of bellows member 70 can be attached. Within the hollow cavity formed by cowl 80', lens member 43" is attached to the cowl by suitable conventional means (not shown) while lens member 44" is movable within the cowl structure. As lens member 44" moves, movement is also imparted to lens 43" causing the cowl 80' to move from the position shown in full lines in FIG. 4 to the position shown in phantom in FIG. 4 and in full lines in FIG. 5.

Figure 7A:
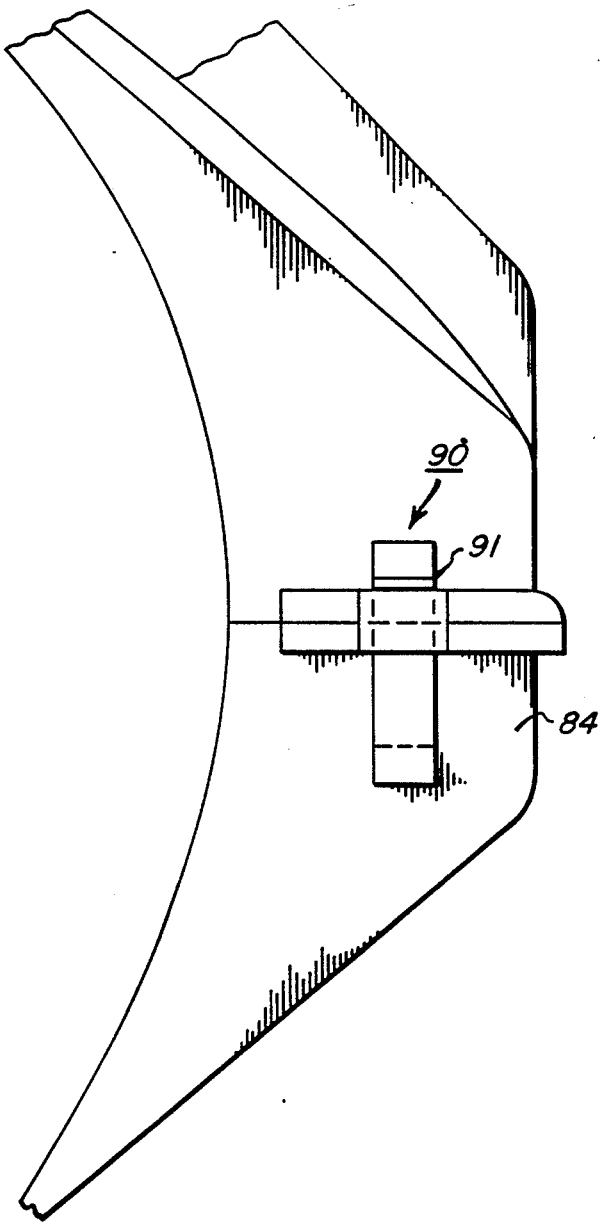
FIG. 7A is a front elevational view of a portion of the cowl shown in FIG. 6 and illustrating a latching member formed integral with the two cowl sections.
Figure 7B:
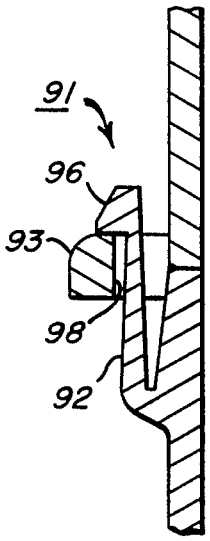
FIG. 7B is a cross-sectional view of the latching member illustrated in FIG. 7A.

With reference now to FIGS. 7A and 7B, the latch area 90 shown generally in FIG. 6 is illustrated more specifically. The latch 91 located in this area is for locking the two halves of the cowl 80' together. The latch 91 comprises a hook-like finger 92 that is molded integral with the bottom half of cowl 80' on the front face 84 of the cowl 80' and an eyelet-type structure 93 molded integral with the top half of cowl 80'. As the top half is assembled and pivoted down upon the bottom half, the resilient coupling of the finger at the base thereof of the front face 84 allows the finger to be cammed clockwise as shown in FIG. 7B by engagement of inclined finger surface 96 formed on finger 92 and surface 98 formed on eyelet structure 93. The resilience of the finger 92 causes same to latch over eyelet structure 93 after passage of same beyond surface 96. A hinge-like structure (not shown) may be provided at the rear of cowl 80' at flange 75' to support the two halves of the cowl for pivotable movement.

Although the invention has been described in detail with particular reference to a preferred application and embodiment thereof, it will be understood that variations and modifications can be effected within the scope and spirit of the invention.

What is claimed is:

1. Reproduction apparatus comprising:

means for supporting a radiation sensitive member for exposure;

optical means including one or more optical elements for forming an image on said radiation sensitive member;

means for supporting an optical element of said optical means in each of at least two extreme positions, in both of which positions the optical element is positioned in an optical path for forming an image upon the member;

bellows means coupled to said optical element;

said bellows means including an outer pleated bellows movable from collapsed to extended positions and an inner light excluding means supported for movement within the outer bellows means;

the pleated bellows being supported at one end by a stationary frame-like member and at a second end by a movable frame-like member, an optical element being movable within the outer bellows during collapsing of this outer bellows and, with the outer bellows collapsed, the optical element being located at one extreme position to one side of said stationary support and, with the outer bellows extended, the optical element being located to the other side of the stationary support.

2. The apparatus of Claim 1 and wherein the optical element in one of its extreme positions extends to one side of said stationary support member to a first area of said apparatus exposed to actinic radiation and non-imaged radiation is blocked by a cowl surrounding said optical element from entering a second area of said apparatus containing said radiation sensitive member.

3. The apparatus of Claim 2 and wherein the cowl comprises a hollow cavity forming member that is comprised of two parts and wherein one of the parts comprises a latch finger means integrally molded therewith so as to provide resilient movement of said finger during assembly of said cowl parts and the other of said parts including a surface cooperating with said finger for engaging said finger to prevent separation of said cowl parts.

4. The apparatus of Claim 1 and wherein said bellows means includes a second pleated bellows element that is in an extended state when said optical element is in one of its extreme positions and said outer bellows is in its collapsed state.

5. Reproduction apparatus comprising:

means for supporting a radiation sensitive member for exposure;

optical means including one or more optical elements for forming an image on said radiation sensitive member;

means for supporting an optical element of said optical means in each of at least two positions, in both of which positions the optical element is positioned in an optical path for forming an image upon the member;

dual bellows means coupled to said optical element;

said bellows means including an outer pleated bellows movable from collapsed to extended states and an inner bellows means supported for movement within the outer bellows means and movable from extended to collapsed states;

means for supporting said dual bellows means so that movement of the inner bellows to its extended state causes movement of said outer bellows to its collapsed position and movement of the inner bellows to its collapsed state causes movement of said outer bellows to its extended position.

6. A bellows comprising a first pleated bellows member having a forward end and a rearward end and adapted for extension in a first direction and collapsing in a second direction; a second pleated bellows member having a forward end and a rearward end, the rearward end of the second bellows member being attached directly to the forward end of said first bellows member, the second pleated bellows member being adapted to move to an extended state with movement of the first pleated bellows member to its collapsed state.

* * * * *